US009971257B2

(12) United States Patent
Sugiyama et al.

(10) Patent No.: US 9,971,257 B2
(45) Date of Patent: May 15, 2018

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Kazumichi Sugiyama, Numazu (JP); Kazunori Noguchi, Suntou-gun (JP); Harunobu Ogaki, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/432,840

(22) Filed: Feb. 14, 2017

(65) Prior Publication Data

US 2017/0242350 A1 Aug. 24, 2017

(30) Foreign Application Priority Data

Feb. 19, 2016 (JP) ..... 2016-030170

(51) Int. Cl.

| | |
|---|---|
| ***G03G 5/147*** | (2006.01) |
| ***G03G 5/043*** | (2006.01) |
| ***G03G 21/18*** | (2006.01) |
| ***G03G 15/00*** | (2006.01) |

(52) U.S. Cl.

CPC ..... *G03G 5/043* (2013.01); *G03G 15/75* (2013.01); *G03G 21/18* (2013.01)

(58) Field of Classification Search

CPC ..... G03G 5/14752; G03G 5/14756

See application file for complete search history.

(56) References Cited

U.S. PATENT DOCUMENTS

| | | | | |
|---|---|---|---|---|
| 2003/0190540 | A1* | 10/2003 | Shoshi | C07D 209/58 430/78 |
| 2010/0092212 | A1* | 4/2010 | Ogawa | G03G 5/0564 399/159 |
| 2015/0337079 | A1* | 11/2015 | Ogawa | C08G 63/193 428/220 |

FOREIGN PATENT DOCUMENTS

| | | | |
|---|---|---|---|
| JP | 10-20514 | A | 1/1998 |
| JP | 3492125 | B2 | 2/2004 |
| JP | 2006-53549 | A | 2/2006 |
| JP | 2007-79555 | A | 3/2007 |
| JP | 2008-74714 | A | 4/2008 |
| JP | 2011-007914 | A | 1/2011 |
| JP | 2011-26574 | A | 2/2011 |

* cited by examiner

*Primary Examiner* — Peter L Vajda

(74) *Attorney, Agent, or Firm* — Canon U.S.A. Inc., IP Division

(57) ABSTRACT

An electrophotographic photosensitive member including a surface layer containing a charge generating material and a polyester resin is provided. The polyester resin contains a structure having a 12- or higher-membered cycloalkylene group.

9 Claims, 1 Drawing Sheet

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

Field of the Invention

The present disclosure relates to an electrophotographic photosensitive member, a process cartridge, and an electrophotographic apparatus.

Description of the Related Art

High-volume printing and high-speed printing are required of electrophotographic processes, and high response is required of electrophotographic photosensitive members, accordingly. Japanese Patent Laid-Open No. 2008-74714 discloses a technique using a charge transporting material having a high charge mobility in the charge transport layer for increasing the responsiveness of an electrophotographic photosensitive member.

If the charge transport layer acts as the surface layer or uppermost layer, it is further required to be resistant to externally applied electrical and mechanical forces. Accordingly, Japanese Patent No. 3492125 and Japanese Patent Laid-Open Nos. 2006-53549 and 2011-26574 disclose techniques using a photosensitive member including a surface layer made of a polyester or polycarbonate resin having a high mechanical strength. Japanese Patent 3492125 discloses an electrophotographic photosensitive member including a surface layer made of a polyester resin having a cyclohexylidene ring. Japanese Patent Laid-Open No. 2006-53549 discloses an electrophotographic photosensitive member including a surface layer made of a polyester resin containing a diphenyl ether dicarboxylic acid moiety. Japanese Patent Laid-Open No. 2011-26574 discloses an electrophotographic photosensitive member using a polycarbonate copolymer having a specific composition on a mole basis. Any of these disclosures describes that the durability of the electrophotographic photosensitive member is improved.

SUMMARY OF THE INVENTION

The present disclosure provides an electrophotographic photosensitive member including a surface layer containing a charge transporting material and a polyester resin. The polyester resin has the structure represented by general formula (I) and the structure represented by general formula (II):

(I)

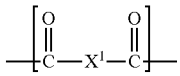

wherein in general formula (I), $X^1$ represents a divalent group.

(II)

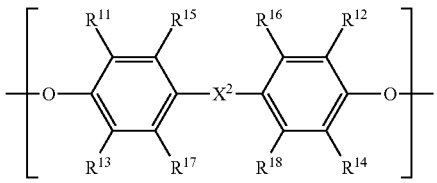

wherein in general formula (II), $X^2$ represents one selected from the group consisting of a single bond, an oxygen atom, a divalent alkylene group, and a divalent cycloalkylene group, and $R^{11}$ to $R^{18}$ each represent a hydrogen atom or an alkyl group.

The structure represented by general formula (I) includes at least one structure selected from the group consisting of the structure represented by formula (I-1), the structure represented by formula (I-2), the structure represented by formula (I-3), and the structure represented by formula (I-4):

(I-1)

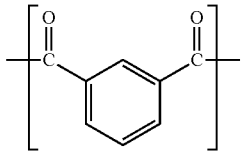

(I-2)

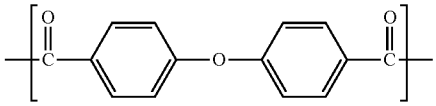

(I-3)

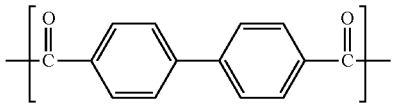

(I-4)

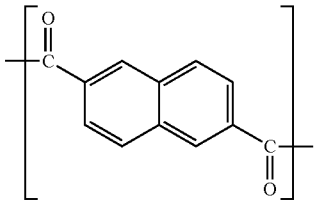

The structure represented by general formula (II) includes the structure represented by general formula (II-1):

(II-1)

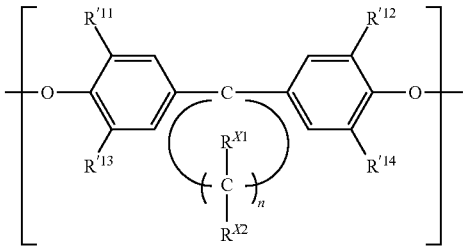

wherein in general formula (II-1), $R^{X1}$ and $R^{X2}$ each represent a hydrogen atom, a methyl group, or an ethyl group, $R'^{11}$, $R'^{12}$, $R'^{13}$, and $R'^{14}$ each represent a hydrogen atom or a methyl group, and n represents an integer in the range of 11 to 18.

According to another aspect of the present disclosure, a process cartridge capable of removably mounted to an electrophotographic apparatus is provided. The process cartridge includes the above-described electrophotographic photosensitive member and at least one device selected from the group consisting of a charging device, a developing device, a transfer device, and a cleaning device. The electrophotographic photosensitive member and the device are held in one body.

Also, an electrophotographic apparatus is provided. The apparatus includes the above-described electrophotographic photosensitive member, a charging device, an exposure device, a developing device, and a transfer device.

Further features of the present disclosure will become apparent from the following description of exemplary embodiments with reference to the attached drawings.

DESCRIPTION OF THE EMBODIMENTS

Figure 1:
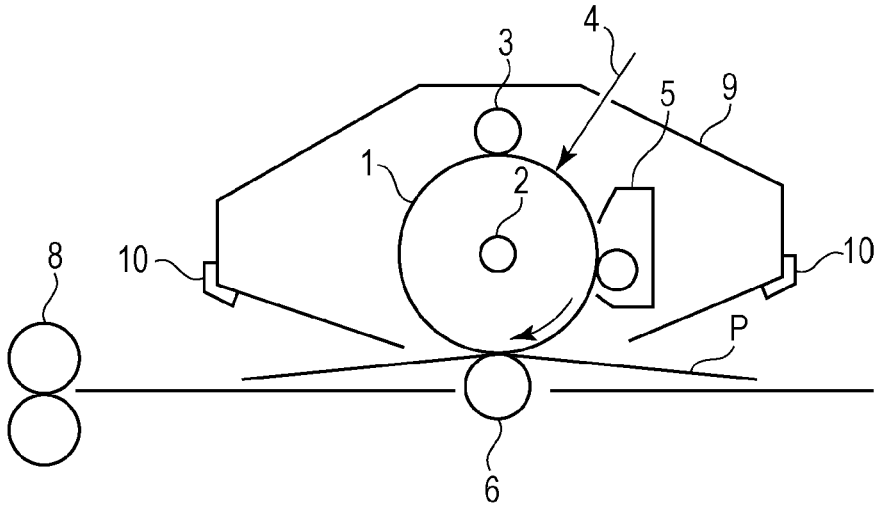
FIG. 1 is a schematic view of the structure of an electrophotographic apparatus provided with a process cartridge.

In an examination by the present inventors, while the electrophotographic photosensitive members using a polyester resin or a polycarbonate resin, disclosed in the above-cited Japanese Patent No. 3492125 and Japanese Patent Laid-Open Nos. 2006-53549 and 2011-26574 exhibited improve durability, the responsiveness thereof did not reach the level required in recent years.

Accordingly, the present disclosure provides an electrophotographic photosensitive member having both a high durability and a high responsiveness. The present disclosure also provides a process cartridge and an electrophotographic apparatus that include the electrophotographic photosensitive member.

The electrophotographic photosensitive member according to an embodiment of the present disclosure includes a surface layer containing a charge transporting material and a polyester resin. The polyester resin has the structure represented by general formula (I) and the structure represented by general formula (II). The structure represented by general formula (I) includes at least one structure selected from the group consisting of the structure represented by formula (I-1), the structure represented by formula (I-2), the structure represented by formula (I-3), and the structure represented by formula (I-4). The structure represented by general formula (II) includes the structure represented by general formula (II-1).

(I)

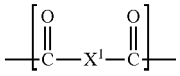

In general formula (I), $X^1$ represents a divalent group. Examples of the divalent group include phenylene, biphenylene, naphthylene, alkylene, cycloalkylene, and a divalent group (-Ph-O-Ph-) having two p-phenylene groups bound with an oxygen atom.

(II)

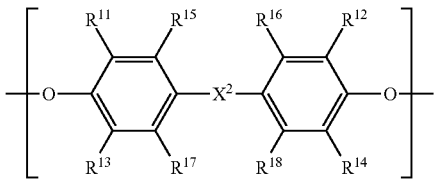

In general formula (II), $X^2$ represents one selected from the group consisting of a single bond, an oxygen atom, a divalent alkylene group, and a divalent cycloalkylene group, and $R^{11}$ to $R^{18}$ each represent a hydrogen atom or an alkyl group.

(I-1)

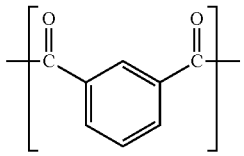

(I-2)

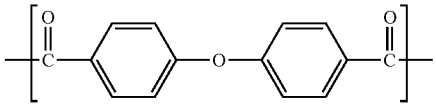

(I-3)

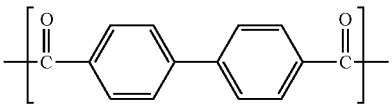

(I-4)

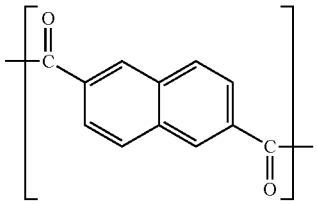

(II-1)

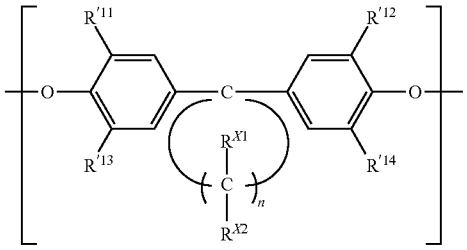

In general formula (II-1), $R^{X1}$ and $R^{X2}$ each represent a hydrogen atom, a methyl group, or an ethyl group, $R'^{11}$, $R'^{12}$, $R'^{13}$, and $R'^{14}$ each represent a hydrogen atom or a methyl group, and n represents an integer in the range of 11 to 18.

The present inventors assume that the reason why charge mobility is increased by using the above-described polyester resin in the surface layer containing a charge transporting material is as below.

The Polyester resin often used as a binder resin in the surface layer containing a charge transporting material has aromatic rings. Since the aromatic rings tend to stack, the charge transporting material is hindered from entering among the resin molecules. Thus, the charge transporting material is likely to be nonuniformly distributed in the surface layer, and consequently, charge mobility is reduced.

On the other hand, the polyester resin used in the embodiments of the present disclosure contains a bisphenol moiety having a 12- or higher-membered aliphatic ring (when n=11 in general formula (II-1), the aliphatic ring is a 12-membered ring). This alicyclic ring structure is very bulky and accordingly can hinder the polyester resin molecules from stacking, thus allowing the charge transporting material to be present among the resin molecules. Consequently, the charge transporting material can be uniformly distributed throughout the surface layer. The polyester resin further contains at least one structure selected from the group consisting of the structure represented by formula (I-1), the structure represented by formula (I-2), the structure represented by formula (I-3), and the structure represented by formula (I-4) that are each a dicarboxylic acid compound (compound deriving a structure represented by general formula (I)) capable of reacting with a bisphenol compound deriving a structure represented by general formula (II) to synthesize a polyester material, together with the structure represented by general formula (II-1). These structures synergistically increase charge mobility and durability.

Examples of the structure represented by general formula (II-1) include:

(II-1-1)

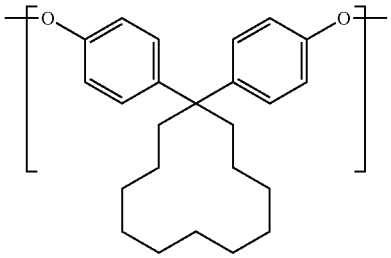

(II-1-2)

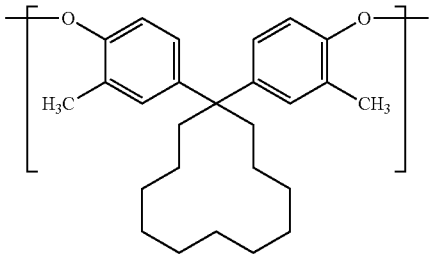

(II-1-3)

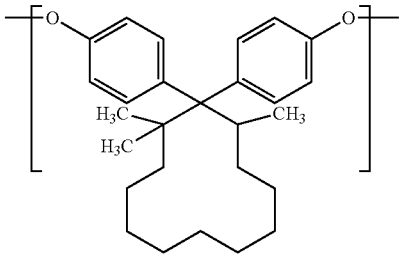

(II-1-4)

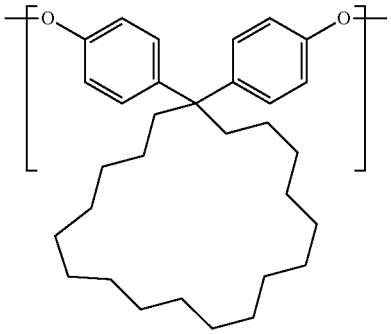

The structure represented by general formula (II) may have 12-membered ring, that is, a structure represented by general formula (II-1) where n=11. This is because 12-membered rings have the most stable conformation. In particular, the structures of general formula (II) represented by formulas (II-1-1) and (II-1-2) are advantageous. The structure represented by formula (II-1-1) is still more advantageous.

Desirably, in the polyester resin, the proportion of the total moles of the structure represented by formula (I-1), the structure represented by formula (I-2), the structure represented by formula (I-3), and the structure represented by formula (I-4) to the total moles of the structures represented by general formula (I) is 30% by mole or more.

Desirably, in the polyester resin, the proportion of the moles of the structures represented by general formula (II-1) to the total moles of the structures represented by general formula (II) is 10% by mole or more, more desirably in the range of 10% to 70% by mole. When the structures of general formula (II-1) account for 10% by mole or more of the structures of general formula (II), the charge transporting material can be uniformly distributed throughout the surface layer.

The structures represented by general formula (II) may further include a structure represented by general formula (II-2):

(II-2)

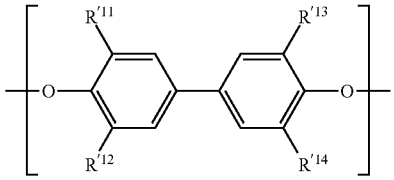

wherein in general formula (II-2), $R'^{11}$, $R'^{12}$, $R'^{13}$, and $R'^{14}$ each represent a hydrogen atom or a methyl group.

Such polyester resin further increases durability. The copolymer formed with these structures may be in any form, such as block copolymer, random copolymer, or alternating copolymer.

Desirably, in view of both charge mobility and durability, the structures represented by general formula (II-1) account for 30% by mole to 50% by mole and the structures represented by general formula (II-2) account for 50% by mole to 70% by mole of the total moles, of the structures represented by general formula (II) in the polyester resin.

Examples of the structure represented by general formula (II-2) include:

(II-2-1)

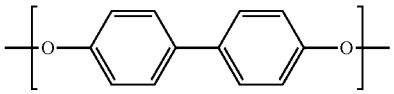

(II-2-2)

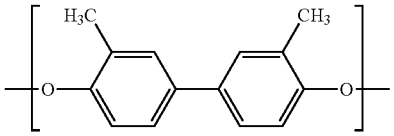

(II-2-3)

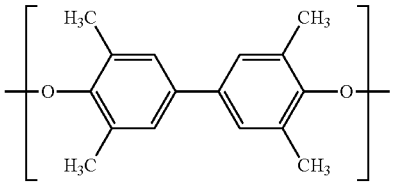

The structures represented by formulas (II-2-1) and (II-2-3) are more advantageous.

The structures represented by general formula (I) may further include a structure represented by formula (I-5):

(I-5)

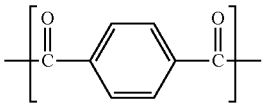

The structures represented by general formula (II) may further include structures represented by any of the formulas (II-3) to (II-8):

(II-3)

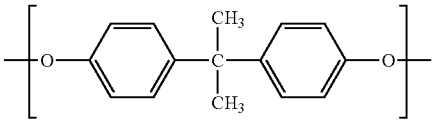

(II-4)

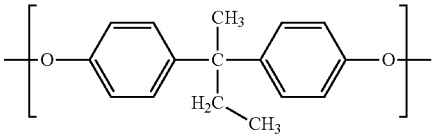

(II-5)

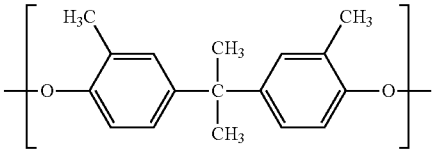

(II-6)

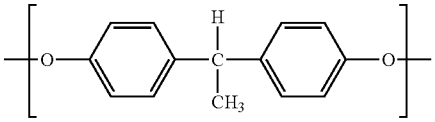

(II-7)

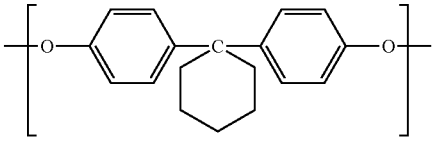

(II-8)

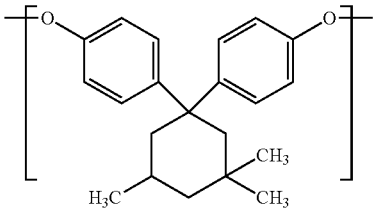

The copolymer formed with above-described structures may be in any form, such as block copolymer, random copolymer, or alternating copolymer. Some of the polyester resins having the above-described structures may be mixed.

The surface layer may further contain any other resin as a binder resin. Such resins include polycarbonate resin, polymethacrylic acid ester resin, polysulfone resin, and polystyrene resin. Some of these resins may be mixed or copolymerized. If any of these resins other than the polyester resin is used, it is desirable that the proportion of the mass of the above-described polyester resin to the total mass of the binder resins be 50% by mass or more.

The weight average molecular weight of the polyester resin is in the range of 60,000 to 200,000, such as in the range of 80,000 to 150,000. This weight average molecular weight refers to the polystyrene-equivalent weight average molecular weight measured by the method disclosed in Japanese Patent Laid-Open No. 2007-79555. Electrophotographic Photosensitive Member The electrophotographic photosensitive member according to an embodiment of the present disclosure includes a surface layer containing a charge transporting material. The electrophotographic photosensitive member may further include a support member and a photosensitive layer. The photosensitive layer may be: (1) a multilayer photosensitive layer; or (2) a single-layer photosensitive layer. (1) The multilayer photosensitive layer includes a charge generating layer containing a charge generating material, and a charge transport layer containing a charge transporting material. (2) The single-layer photosensitive layer is a photosensitive layer containing a charge generating material and a charge transporting material together. In the case of (1) using a multilayer photosensitive layer in an embodiment of the present disclosure, the surface layer containing a charge transporting material acts as the charge transport layer. In the case of (2) using a single-layer photosensitive layer, the surface layer containing a charge transporting material acts as the photosensitive layer. These layers will now be described.

The electrophotographic photosensitive member may be produced by applying each of the coating liquids prepared for forming the layers thereof, which will be described later, in a desired order, and drying the coatings. The coating liquids may be applied by dipping (dip coating), spray coating, curtain coating, or spin coating. From the viewpoint of efficiency and productivity, dipping is advantageous.

Support Member

The electrophotographic photosensitive member may include a support member. Desirably, the support member is electrically conductive. The electrically conductive support member may be made of a metal, such as aluminum, iron, nickel, copper, or gold, or an alloy thereof. Alternatively, an insulating support member made of, for example, a polyester resin, a polycarbonate resin, a polyimide resin, or glass may be coated with a metal thin film made of, for example, aluminum, chromium, silver, or gold, electrically conductive metal oxide thin film made of, for example, indium oxide, tin oxide, or zinc oxide, or a thin layer of an electrically conductive ink containing silver nanowires.

The support member may be subjected to surface treatment by electrochemical operation such as anodization, or wet honing, blast or cutting to improve the electrical properties and suppress the occurrence of interference fringes.

The support member may be in the form of a cylinder, a belt, a film, or the like.

Electroconductive Layer

An electroconductive layer may be disposed on the support member. The average thickness of the electroconductive layer may be in the range of 0.2 μm to 40 μm, such as 1 μm to 35 μm or 5 μm to 30 μm.

The electroconductive layer may contain metal oxide particles and a binder resin. Examples of the metal oxide of the metal oxide particles include zinc oxide, white lead, aluminum oxide, indium oxide, silicon oxide, zirconium oxide, tin oxide, titanium oxide, magnesium oxide, antimony oxide, bismuth oxide, tin-doped indium oxide, and antimony- or tantalum-doped tin oxide or zirconium oxide, particles of zinc oxide, titanium oxide, or tin oxide are advantageous. The number average particle size of the metal oxide particles may be in the range of 30 nm to 450 nm, such as in the range of 30 nm to 250 nm, from the viewpoint of preventing local formation of conductive paths that is a cause of black points.

The binder resin may be a polyester resin, a polycarbonate resin, a polyvinyl butyral resin, an acrylic resin, a silicone resin, an epoxy resin, a melamine resin, a urethane resin, a phenol resin, or an alkyd resin.

The electroconductive layer may be formed by applying a coating liquid prepared for the electroconductive layer onto the support member. The coating liquid for the electroconductive layer may contain a solvent in addition to the metal oxide particles and the binder resin. This solvent may be an alcohol-based solvent, a sulfoxide-based solvent, a ketone-based solvent, an ether-based solvent, an ester-based solvent, or an aromatic hydrocarbon. The metal oxide particles are dispersed in the coating liquid by using, for example, a paint shaker, a sand mill, a ball mill, or a high-speed liquid collision disperser. The metal oxide particles may be surface-treated with a silane coupling agent or the like so as to be highly dispersed. Also, the metal oxide particles may be doped with another metal or metal oxide to regulate the resistance of the electroconductive layer.

Undercoat Layer

An undercoat layer may be disposed on the support member or the electroconductive layer. The undercoat layer acts as a barrier and enhances adhesion. The average thickness of the undercoat layer may be in the range of 0.05 μm to 40 μm, such as 0.05 μm to 7 μm or 0.1 μm to 2 μm.

It is advantageous for preventing charges generated from the charge generating layer from staying there that the undercoat layer contain an electron transporting material and a binder resin. Such an undercoat layer allows the electrons of the charges generated from the charge generating layer to be transported to the support member. Consequently, charge deactivation during generation of charges and trap increase can be suppressed even if the charge transport ability is increased. Thus, electrical properties at the beginning and during repeated use are improved.

Examples of the electron transporting material include quinone compounds, imide compounds, benzimidazole compounds, cyclopentadienylidene compounds, fluorenone compounds, xanthone-based compounds, benzophenone-based compounds, cyanovinyl-based compounds, naphthylimide compounds, and peryleneimide compounds. The electron transporting material may have a polymerizable functional group, such as hydroxy, thiol, amino, carboxy, or methoxy.

Examples of the binder resin include polyacrylic acid-based resin, methyl cellulose, ethyl cellulose, polyamide resin, polyimide resin, poly(amide-imide) resin, polyamide acid resin, urethane resin, melamine resin, and epoxy resin. Alternatively, the binder resin may be a polymer having a cross-linked structure formed by thermally polymerizing (curing) a thermosetting resin having a polymerizable functional group, such as acetal resin or alkyd resin, and a monomer having a polymerizable functional group, such as an isocyanate compound.

The undercoat layer can be formed by applying a coating liquid for forming the undercoat layer containing a binder resin, and drying the coating.

Photosensitive Layer (1) Multilayer Photosensitive Layer

If the photosensitive layer has a multilayer structure, the electrophotographic photosensitive member includes a charge generating layer containing a charge generating material, and a charge transport layer containing a charge transporting material and a polyester resin containing the structure represented by general formula (I) and the structure represented by general formula (II).

(1-1) Charge Generating Layer

The average thickness of the charge generating layer may be in the range of 0.05 μm to 5 μm, such as 0.05 μm to 1 μm or 0.1 μm to 0.3 μm.

Examples of the charge generating material include azo pigments, perylene pigments, anthraquinone derivatives, anthanthrone derivatives, dibenzpyrenequinone derivatives, pyranthrone derivatives, violanthrone derivatives, isoviolanthrone derivatives, indigo derivatives, thioindigo derivatives, phthalocyanine pigments, and bisbenzimidazole derivatives. Among these, azo pigments and phthalocyanine pigments are advantageous. Advantageous phthalocyanine pigments include oxytitanium phthalocyanine, chlorogallium phthalocyanine, and hydroxygallium phthalocyanine.

The charge generating layer also contains a binder resin. Examples of the binder resin include polymers or copolymers of vinyl compounds, such as styrene, vinyl acetate, vinyl chloride, acrylic acid esters, methacrylic acid esters, vinylidene fluoride, and trifluoroethylene; and polyvinyl alcohol resin, polyvinyl acetal resin, polycarbonate resin, polyester resin, polysulfone resin, polyphenylene oxide resin, polyurethane resin, cellulose resin, phenol resin, melamine resin, silicone resin, and epoxy resin. Among these, polyester resin, polycarbonate resin, and polyvinyl acetal resin are advantageous. Polyvinyl acetal resin is particularly advantageous.

The charge generating material content in the charge generating layer is desirably in the range of 30% by mass to 90% by mass, such as in the range of 50% by mass to 80% by mass, relative to the total mass of the charge generating layer.

In the charge generating layer, the mass ratio of the charge generating material to the binder resin (mass of the charge generating material/mass of the binder resin) may be in the range of 10/1 to 1/10, such as 5/1 to 1/5.

The charge generating layer may be formed by applying a coating liquid for the charge generating layer prepared by mixing a charge generating material and a binder resin with a solvent, and drying the coating. The solvent used in the coating liquid for the charge generating layer may be an alcohol-based solvent, a sulfoxide-based solvent, a ketone-based solvent, an ether-based solvent, an ester-based solvent, or an aromatic hydrocarbon.

(1-2) Charge Transport Layer

The thickness of the charge transport layer may be in the range of 5 μm to 50 μm, such as in the range of 10 μm to 35 μm.

Examples of the charge transporting material in the charge transport layer include polycyclic aromatic compounds, heterocyclic compounds, hydrazone compounds, styryl compounds, enamines, benzidine compounds, triarylamine compounds, and triphenylamine. Alternatively, the charge transporting material may be a polymer having a group derived from these compounds in the main chain or a side chain. Triarylamine compounds and benzidine compounds are advantageous in terms of potential stability during repeated use. A plurality of charge transporting materials may be used in combination. The following are exemplary charge transporting materials.

(CTM-1)
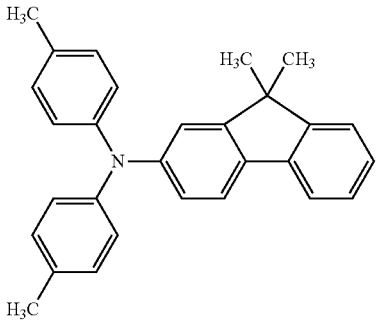
(CTM-2)
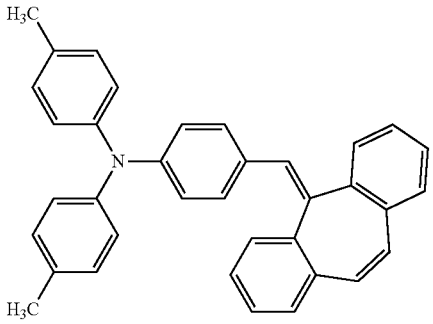
(CTM-3)
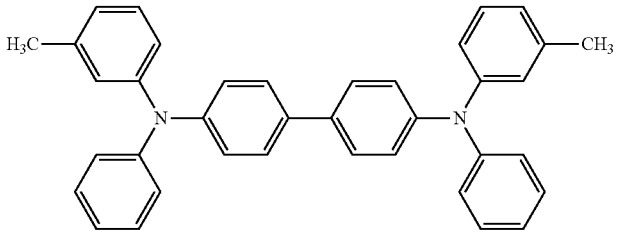
(CTM-4)
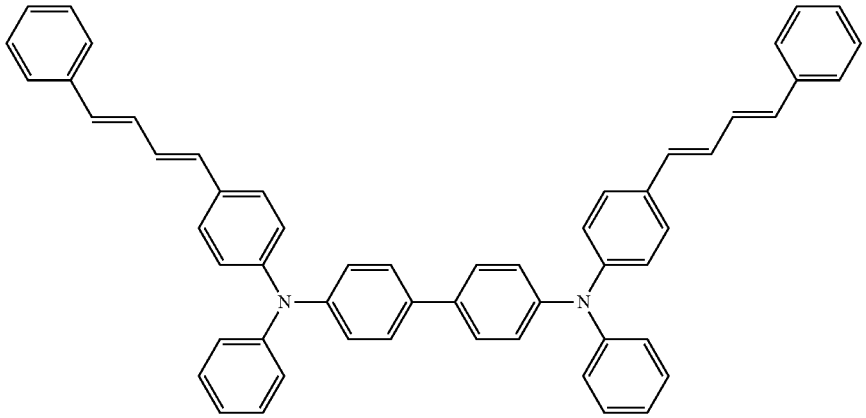
(CTM-5)
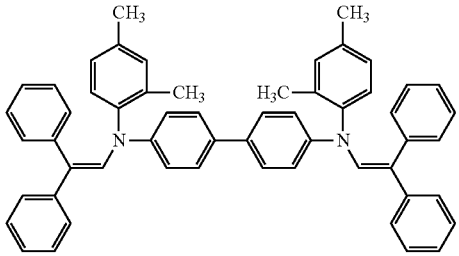
(CTM-6)
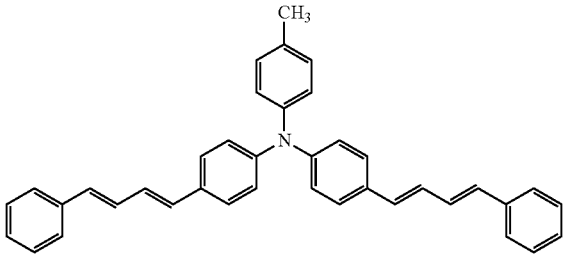

-continued (CTM-7)

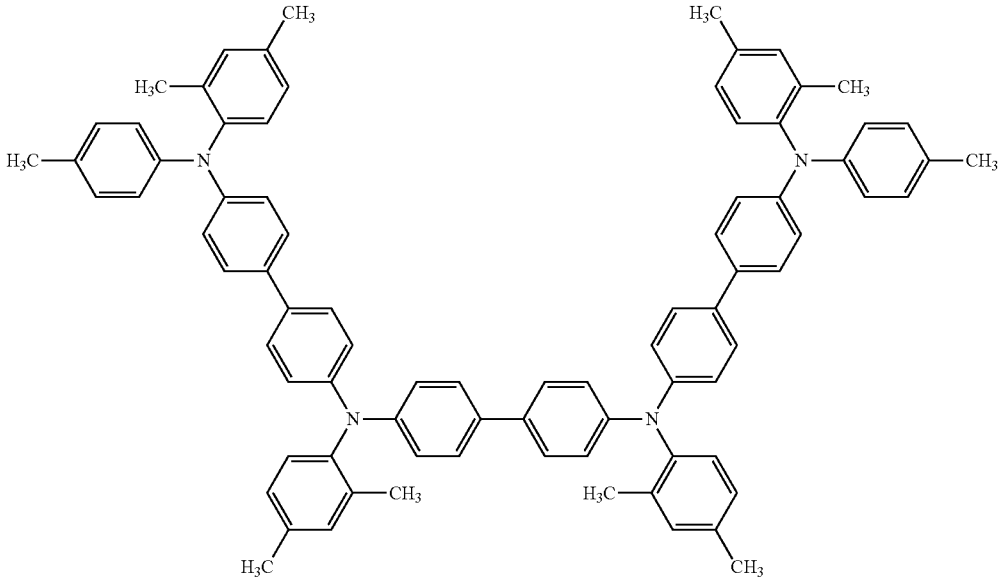

(CTM-8)

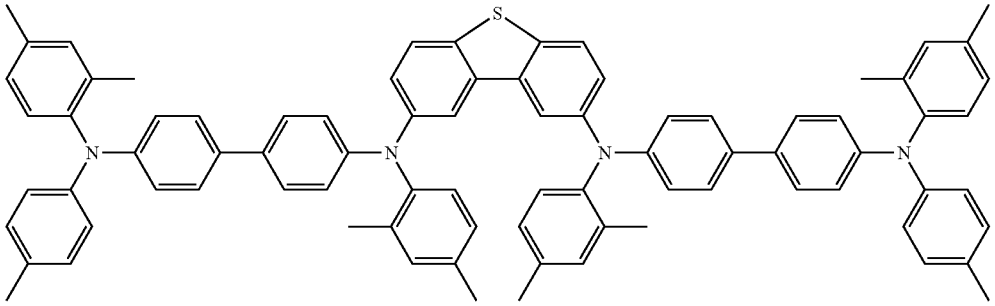

(CTM-9)

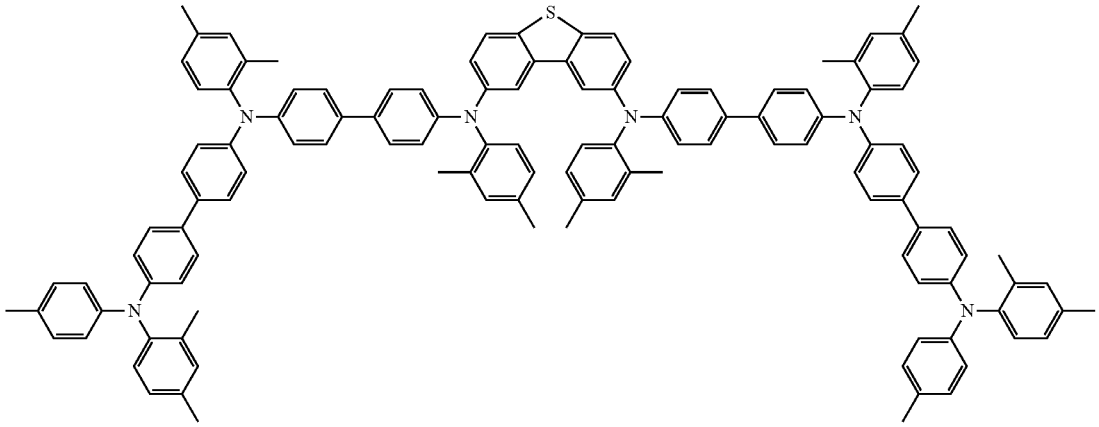

The binder resin used in the charge transport layer may be polyester, acrylic resin, phenoxy resin, polycarbonate, polystyrene, polyvinyl acetate, polysulfone, polyarylate, vinylidene chloride, and acrylonitrile copolymer. Among these, polycarbonate and polyarylate are advantageous.

The charge transporting material content in the charge transport layer is desirably in the range of 20% by mass to 80% by mass, such as in the range of 30% by mass to 60% by mass, relative to the total mass of the charge transport layer.

The charge transport layer may be formed by applying a coating liquid for the charge transport layer prepared by dissolving a charge transporting material and a binder resin in a solvent, and drying the coating. The solvent used in the coating liquid for forming the charge transport layer may be an alcohol-based solvent, a sulfoxide-based solvent, a ketone-based solvent, an ether-based solvent, an ester-based solvent, or an aromatic hydrocarbon.

(2) Single-Layer Photosensitive Layer

If the photosensitive layer has a single-layer structure, the photosensitive layer contains a charge generating material, a charge transporting material, and a polyester resin containing the structure represented by general formula (I) and the structure represented by general formula (II). The photosensitive layer may be formed by applying a coating liquid for the photosensitive layer prepared by dissolving the charge generating material, the charge transporting material, and a binder resin in a solvent, and drying the coating. The charge transporting material and the binder resin may be selected from among the same materials cited in "(1) Multilayer Photosensitive Layer".

Protective Layer

The surface layer may be covered with a protective layer as long as the advantageous effect intended in the present disclosure can be produced. The protective layer may contain electrically conductive particles or a charge transporting material and a binder resin. The protective layer may further contain an additive, such as a lubricant. The binder resin in the protective layer may have electrical conductivity or charge transporting ability. In this instance, electrically conductive particles or a charge transporting material need not be added to the protective layer. The binder resin in the protective layer may be thermoplastic, or may be a resin cured by heat, light, or radiation (e.g. electron beam).

Process Cartridge and Electrophotographic Apparatus

The process cartridge according to an embodiment of the present disclosure is removably mounted to an electrophotographic apparatus and includes the above-described electrophotographic photosensitive member and at least one device selected from the group consisting of a charging device, a developing device, a transfer device, and a cleaning device. The electrophotographic photosensitive member and these devices are held in one body.

Also, the electrophotographic apparatus according to an embodiment of the present disclosure includes the above-described electrophotographic photosensitive member, a charging device, an exposure device, a developing device, and a transfer device.

FIG. 1 is a schematic view of the structure of an electrophotographic apparatus provided with a process cartridge including an electrophotographic photosensitive member.

This electrophotographic photosensitive member 1 is driven for rotation on an axis 2 in the direction indicated by an arrow at a predetermined peripheral speed. The surface (periphery) of the electrophotographic photosensitive member 1 driven for rotation is uniformly charged to a predetermined positive or negative potential by a charging device 3 (primary charging device such as charging roller). Then, the surface or periphery is subjected to exposure (image exposure) 4 from an exposure device (not shown), such as a slit exposure or laser beam scanning exposure device. Thus electrostatic latent images corresponding to desired images are formed one after another on the surface of the electrophotographic photosensitive member 1.

The electrostatic latent images formed on the surface of the electrophotographic photosensitive member 1 are then developed into toner images with the toner contained in the developer of the developing device 5. Subsequently, the toner images on the surface of the electrophotographic photosensitive member 1 are transferred to a transfer medium P, such as a paper sheet, one after another from a transfer device 6, such as a transfer roller. The toner images on the surface of the electrophotographic photosensitive member 1 may be transferred once to an intermediate transfer medium and then to the transfer medium such as a paper sheet. The transfer medium P is fed to an abutting portion between the electrophotographic photosensitive member 1 and the transfer device 6 from a transfer medium feeder (not shown) in synchronization with the rotation of the electrophotographic photosensitive member 1.

The transfer medium P to which the toner images have been transferred is separated from the surface of the electrophotographic photosensitive member 1 and introduced into a fixing device 8, in which the toner images are fixed, thus being ejected as an image-formed article (printed material or copy).

The surface of the electrophotographic photosensitive member 1 after the toner images have been transferred is cleaned with a cleaning device 7, such as a cleaning blade, to remove therefrom the developer (toner) remaining after transfer. Subsequently, the electrophotographic photosensitive member 1 is subjected to pre-exposure (not shown) with the exposure device (not shown) to remove static electricity before being reused to form images. If the charging device 3 is of contact charging type, such as a charging roller as shown in FIG. 1, however, pre-exposure is not necessarily required.

Some of the components of the electrophotographic apparatus including the electrophotographic photosensitive member 1, the charging device 3, the developing device 5, the transfer device 6, and the cleaning device 7 may be combined in a single container as an integrated process cartridge. The process cartridge may be removably mounted to an electrophotographic apparatus such as a copy machine or a laser beam printer. In the embodiment shown in FIG. 1, the electrophotographic photosensitive member 1, the charging device 3, the developing device 5, and the cleaning device 7 are integrated into a cartridge. The cartridge is guided by a guide 10 such as a rail of the electrophotographic apparatus body, thus being used as a removable process cartridge 9 in the electrophotographic apparatus.

EXAMPLES

The subject matter of the present disclosure will be further described in detail with reference to Examples and Comparative Examples. The subject matter is however not limited to the following Examples. In the following Examples, "part(s)" is on a mass basis unless otherwise specified.

Synthesis of Polyester Resin

Synthesis Example 1: Synthesis of Polyester Resin A

An acid halide solution was prepared by dissolving 42.2 g of a dicarboxylic acid halide in dichloromethane. The dicarboxylic acid halide is represented by the following formula:

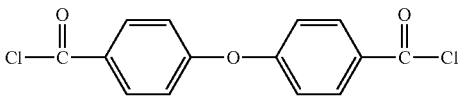

Also, a diol compound solution was prepared by dissolving 50.4 g of a diol in 10% aqueous solution of sodium hydroxide and stirring the solution in the presence of tributylbenzylammonium chloride added as a polymerization catalyst. The diol is represented by the following formula:

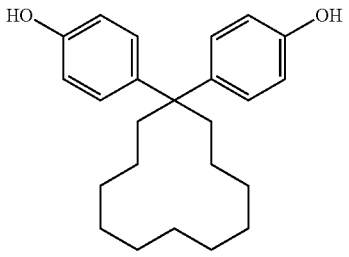

Then, the acid halide solution was added to the diol compound solution with stirring to start a polymerization. The polymerization was made at a reaction temperature kept at 25° C. or less for 3 hours with stirring. During the polymerization reaction, p-tert-butylphenol was added as a polymerization regulator. Then, acetic acid was added to terminate the polymerization reaction, and the reaction solution was repeatedly washed with water until the aqueous phase was turned neutral. After washing, the dichloromethane phase was dropped into methanol to precipitate the polymerization product. The polymerization product was vacuum-dried to yield 65.8 g of polyester resin A. The resulting polyester resin A had the structure represented by formula (I-2) and the structure represented by formula (II-1-1). Polyester resin A had a weight average molecular weight of 120,000.

Synthesis Examples 2 to 26

Polyester resins B to Z shown in Table 1 were synthesized in the same manner as in Synthesis Example 1.

TABLE 1

Polyester Resin Synthesis Examples

| Synthesis Example No. | Polyester resin No. | Structures (type and mole percent) Structure of general formula (I) | Structure of general formula (II) | Weight average molecular weight of polyester resin |
|---|---|---|---|---|
| Synthesis Example 1 | A | I-2 | II-1-1 | 120,000 |
| Synthesis Example 2 | B | I-4 | II-1-1 | 110,000 |
| Synthesis Example 3 | C | I-2 | II-1-1/II-2-3(30/70) | 110,000 |
| Synthesis Example 4 | D | I-2 | II-1-1/II-2-3(50/50) | 90,000 |
| Synthesis Example 5 | E | I-2/I-4 (70/30) | II-1-1/II-2-3(30/70) | 100,000 |
| Synthesis Example 6 | F | I-2 | II-1-1/II-2-3(10/90) | 110,000 |
| Synthesis Example 7 | G | I-2 | II-1-1/II-2-3(5/95) | 100,000 |
| Synthesis Example 8 | H | I-2 | II-1-1/II-2-1(30/70) | 120,000 |
| Synthesis Example 9 | I | I-2 | II-1-1/II-2-2(30/70) | 90,000 |
| Synthesis Example 10 | J | I-2/I-5 (50/50) | II-1-1/II-7(50/50) | 110,000 |
| Synthesis Example 11 | K | I-1 | II-1-1 | 110,000 |
| Synthesis Example 12 | L | I-3 | II-1-1 | 100,000 |
| Synthesis Example 13 | M | I-2 | II-1/II-6 (30/70) | 120,000 |
| Synthesis Example 14 | N | I-2 | II-1/II-3 (30/70) | 100,000 |
| Synthesis Example 15 | O | I-2 | II-1/II-4 (30/70) | 130,000 |
| Synthesis Example 16 | P | I-2 | II-1/II-5 (30/70) | 110,000 |
| Synthesis Example 17 | Q | I-2/I-3 (70/30) | II-1-1 | 120,000 |
| Synthesis Example 18 | R | I-1/I-5 (50/50) | II-1-1 | 80,000 |
| Synthesis Example 19 | S | I-2 | II-1-4 | 110,000 |
| Synthesis Example 20 | T | I-2 | II-1-3 | 120,000 |
| Synthesis Example 21 | U | I-2 | II-1-2 | 100,000 |
| Synthesis Example 22 | V | I-2 | II-6 | 110,000 |
| Synthesis Example 23 | W | I-2 | II-7 | 130,000 |
| Synthesis Example 24 | X | I-5/I-1 (50/50) | II-7 | 100,000 |
| Synthesis Example 25 | Y | I-5 | II-1/II-7 (50/50) | 90,000 |
| Synthesis Example 26 | Z | I-2 | II-8 | 110,000 |

In Table 1, the weight average molecular weight of each resin is the polystyrene equivalent weight average molecular weight (Mw).

The proportion or percentage of each structure in the polyester resin can be determined by a conventional analytical method. The proportion of the polyester resin concerned to the total mass of the resins in the surface layer can also be determined by a conventional analytical method. An exemplary analytical method will be described below.

First, the surface layer of the electrophotographic photosensitive member is dissolved in a solvent. Subsequently, the constituents of the surface layer are separated and collected by a size exclusion chromatograph, a high-performance liquid chromatograph, or any other apparatus that can separate and collect the constituents. The polyester resin thus separated and collected was subjected to nuclear magnetic resonance analysis and mass spectroscopy for calculating the number of repetitions and the mole percentage of each structure.

Alternatively, the polyester resin may be hydrolyzed into a carboxylic acid portion and a bisphenol portion, for example, in the presence of an alkali. The bisphenol portion thus obtained was subjected to nuclear magnetic resonance analysis and mass spectroscopy for calculating the number of repetitions and the mole percentage of the structure.

Preparation of Electrophotographic Photosensitive Member

Example 1

An aluminum (aluminum alloy, JIS A3003) cylinder of 260.5 mm in length and 30 mm in diameter was used as a support member (electrically conductive support member).

Then, 214 parts of oxygen-deficient tin oxide-coated titanium oxide particles (metal oxide particles), 132 parts of a phenol resin (product name: Plyophen J-325, manufactured by DIC, resin solids content: 60% by mass) and 98 parts of 1-methoxy-2-propanol were added into a sand mill containing 450 parts of glass beads of 0.8 mm in diameter, and were dispersed in each other at a rotational speed of 2000 rpm with cooling water set to 18° C. for 4.5 hours to yield a dispersion liquid. After dispersing the materials, the glass beads were removed from the dispersion liquid through a mesh (openings: 150 μm). Silicone resin particles (product name: Tospearl 120, manufactured by Momentive Performance Materials, average particle size: 2 μm) were added to the dispersion liquid, from which the glass beads had been removed, in a proportion of 10% by mass relative to the total mass of the metal oxide particles and the binder resin in the dispersion liquid. Also, a silicone oil (product code: SH28PA, manufactured by Dow Corning Toray) was added as a leveling agent to the dispersion liquid in a proportion of 0.01% by mass relative to the total mass of the metal oxide particles and the binder resin in the dispersion liquid, and the mixture was stirred to yield a coating liquid for forming an electroconductive layer. This coating liquid was applied to the surface of the support member by dipping. The resulting coating film was dried and hardened at 150° C. for 30 minutes to yield a 30 μm thick electroconductive layer.

Subsequently, 15 parts of N-methoxymethylated 6-nylon resin (product name: Tresin EF-30T, produced by Nagase Chemtex) and 5 parts of a copolymerized nylon resin (product name: Amilan CM8000, produced by Toray) were dissolved in a mixed solvent of 220 parts of methanol and 110 parts of 1-butanol to yield a coating liquid for forming an undercoat layer. This coating liquid was applied to the surface of the electroconductive layer by dipping. The resulting coating film was dried at 100° C. for 10 minutes to yield a 0.65 μm thick undercoat layer.

Next, 2 parts of a polyvinyl butyral (product name: S-LEC BX-1, produced by Sekisui Chemical) was dissolved in 100 parts of cyclohexanone. To the resulting solution was added 4 parts of crystalline hydroxygallium phthalocyanine (charge generation material) whose CuKα X-ray diffraction spectrum has peaks at Bragg angle 2θ of 7.4°±0.2° and 28.1°±0.2°. The mixture was subjected to dispersion at 23±3° C. for 1 hour in a sand mill with glass beads of 1 mm in diameter. After this dispersion, 100 parts of ethyl acetate was added to the dispersion liquid to yield a coating liquid for forming a charge generating layer. The resulting coating liquid was applied onto the undercoat layer by dipping. The resulting coating film was dried at 90° C. for 10 minutes to yield a 0.20 μm thick charge generating layer.

Subsequently, 9 parts of the compound (charge transporting material) represented by formula (CTM-1) and 10 parts of polyester resin A synthesized in Synthesis Example 1 were dissolved in a mixed solvent of 33 parts of dimethoxymethane and 49 parts of cyclopentanone to yield a coating liquid for forming a charge transport layer.

The coating liquid for the charge transport layer was applied onto the surface of the charge generating layer by dipping. The resulting coating film was dried at 130° C. for 30 minutes to yield a 20 μm thick charge transport layer (surface layer).

Thus, an electrophotographic photosensitive member was produced which includes the support member, the electroconductive layer, the undercoat layer, the charge generating layer, and the charge transport layer in that order.

The resulting electrophotographic photosensitive member was evaluated as described below.

Examples 2 to 21

Electrophotographic photosensitive member samples were prepared in the same manner as in Example 1, except that the polyester resin and the charge transporting material were replaced as shown in Table 2.

Example 22

An electrophotographic photosensitive member was prepared in the same manner as in Example 1, except that the polyester resin was replaced with a mixture of polyester resin A and PC-a (mass ratio: 7:3).

PC-a is a polycarbonate resin (Mw=55,000) having the structure represented by the following formula:

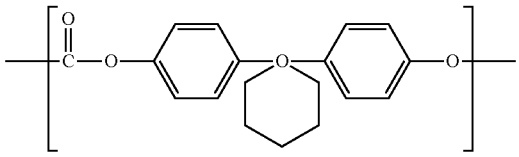

Examples 23 to 29

Electrophotographic photosensitive member samples were prepared in the same manner as in Example 1, except that the polyester resin and the charge transporting material were replaced as shown in Table 2.

Comparative Examples 1 to 3

Electrophotographic photosensitive member samples were produced in the same manner as in Example 1, except that the polyester resin was replaced as shown in Table 2.

Comparative Example 4

The polyester resin used in Example 1 was replaced with polyester resin Y. However, the resin was not dissolved.

Comparative Example 5

Electrophotographic photosensitive member samples were produced in the same manner as in Example 1, except that the polyester resin was replaced as shown in Table 2.

Comparative Example 6

An electrophotographic photosensitive member was prepared in the same manner as in Example 1, except that the polyester resin in the charge transport layer was replaced with PC-b.

PC-b is a polycarbonate resin (Mw=45,000) having the structure represented by the following formula:

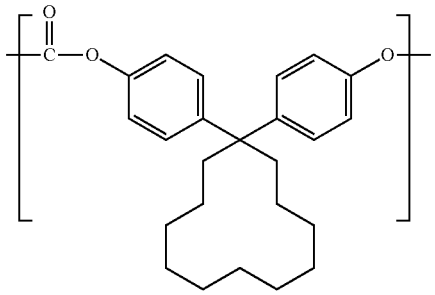

Comparative Example 7

An electrophotographic photosensitive member was prepared in the same manner as in Example 1, except that the polyester resin in the charge transport layer was replaced with PC-c.

PC-c is a polycarbonate resin (Mw=52,000) prepared by synthesizing two structures represented by the following formulas in a mole ratio of 50:50:

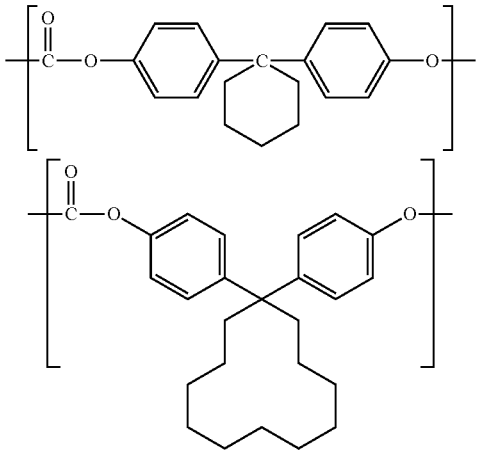

Comparative Examples 8 to 14

Electrophotographic photosensitive member samples were prepared in the same manner as in Example 1, except that the polyester resin and the charge transporting material were replaced as shown in Table 2.

Comparative Example 15

A polycarbonate resin was produced in the same manner as in Example 5 of the above-cited Japanese Patent Laid-Open No. 2011-26574 (paragraph [0154]), and an electrophotographic photosensitive member was prepared in the same manner as in Example 1, except that the polyester resin was replaced with this polycarbonate resin.

Evaluation

Charge Mobility

Charge mobility was measured with a voltage direct application type electrophotographic photosensitive member measuring apparatus using a curved NESA glass.

More specifically, the surface of the electrophotographic photosensitive member was brought into close contact with the NESA glass. Then, a voltage was applied to the NESA glass to charge the electrophotographic photosensitive member to a predetermined surface potential (Vd: −700 V). After the charge was kept for 0.5 second, the voltage applied to the NESA glass was turned off, and the electrophotographic photosensitive member was subjected to directly exposure. The exposure dose was controlled so that the surface potential (Vl) 0.1 second after exposure would be −500 V.

Figure 2:
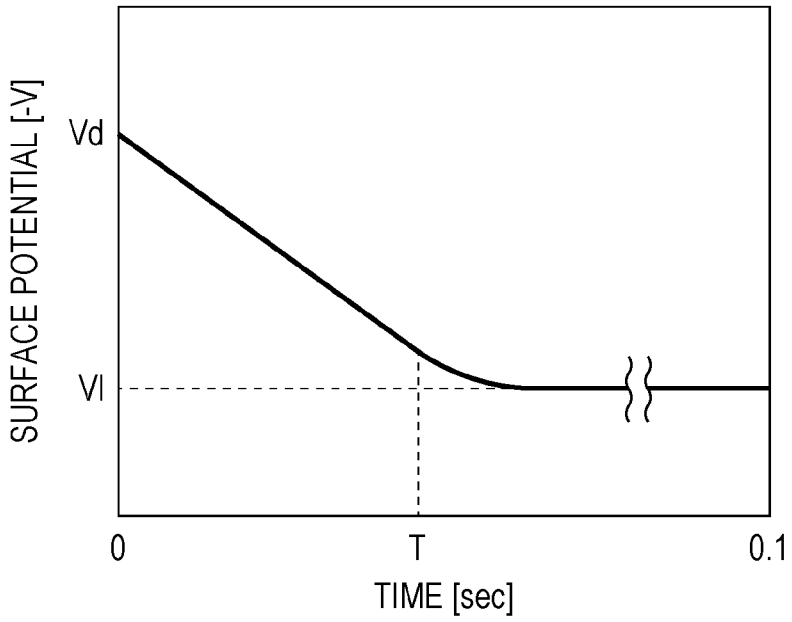
FIG. 2 is a plot of the changes in potential at the surface of an electrophotographic photosensitive member in a charge mobility test.

FIG. 2 is a plot of changes in potential at the surface of an electrophotographic photosensitive member in this test. The period immediately after exposure during which the potential was changing linearly was calculated from the plot shown in FIG. 2 and was defined as charge transport time T. Using the charge transport time T, the thickness d of the charge transport layer, and the surface potential Vd set at the beginning of the measurement, charge mobility μ ($cm^2/Vs$) was calculated from the equation $\mu=d^2/(Vd\cdot T)$.

Durability

For durability test, a test apparatus modified from Hewlett-Packard Color Laser Jet 4700 (for printing 40 sheets per minute) was used. Each sample was tested under the environment of 15° C. in temperature and 10% RH in humidity. After an image pattern was printed on 5,000 sheets of A4 plain paper in an intermittent mode in which printing was stopped every time one printed sheet was output, the decrease in the thickness of the charge transport layer at the surface of the electrophotographic photosensitive member from the initial thickness was measured at the center thereof. For this measurement, a thickness meter Fischer MMS with an eddy current probe EAW 3.3 manufactured by Fischer was used. For evaluation, the decrease in thickness of the charge transport layer obtained after 5,000-sheet image output was converted to the decrease for 1,000 sheets. Test Results of Examples 1 to 29 and Comparative Examples 1 to 14

TABLE 2

Preparation Conditions and Test Results of Electrophotographic Members

| | Preparation conditions | | | Test results | |
|---|---|---|---|---|---|
| Example No. | Charge transport material | Polyester resin No. | Charge transport material/resin mass ratio | Charge mobility $cm^2/Vs$ ($\times10^{-6}$) | Durability: Decrease in thickness (μm) |
| Example 1 | (CTM-1) | A | 9/10 | 7.2 | 0.16 |
| Example 2 | (CTM-1) | B | 9/10 | 10.2 | 0.18 |
| Example 3 | (CTM-1) | C | 9/10 | 7.3 | 0.11 |
| Example 4 | (CTM-1) | D | 9/10 | 7.8 | 0.12 |
| Example 5 | (CTM-1) | E | 9/10 | 7.4 | 0.09 |
| Example 6 | (CTM-1) | F | 9/10 | 5.5 | 0.13 |
| Example 7 | (CTM-1) | G | 9/10 | 4.3 | 0.11 |
| Example 8 | (CTM-1) | H | 9/10 | 6.9 | 0.11 |
| Example 9 | (CTM-1) | I | 9/10 | 6.3 | 0.21 |
| Example 10 | (CTM-1) | J | 9/10 | 4.1 | 0.29 |
| Example 11 | (CTM-1) | K | 9/10 | 4.4 | 0.16 |
| Example 12 | (CTM-1) | L | 9/10 | 7.2 | 0.16 |
| Example 13 | (CTM-1) | M | 9/10 | 4.5 | 0.18 |
| Example 14 | (CTM-1) | N | 9/10 | 4.4 | 0.16 |
| Example 15 | (CTM-1) | O | 9/10 | 4.2 | 0.17 |
| Example 16 | (CTM-1) | P | 9/10 | 4.4 | 0.11 |
| Example 17 | (CTM-1) | Q | 9/10 | 6.5 | 0.31 |

TABLE 2-continued

Preparation Conditions and Test Results of Electrophotographic Members

| Example No. | Preparation conditions: Charge transport material | Preparation conditions: Polyester resin No. | Preparation conditions: Charge transport material/resin mass ratio | Test results: Charge mobility $cm^2/Vs$ ($\times 10^{-6}$) | Test results: Durability: Decrease in thickness (μm) |
|---|---|---|---|---|---|
| Example 18 | (CTM-1) | R | 9/10 | 6.1 | 0.42 |
| Example 19 | (CTM-1) | S | 9/10 | 6.6 | 0.18 |
| Example 20 | (CTM-1) | T | 9/10 | 6.1 | 0.19 |
| Example 21 | (CTM-1) | U | 9/10 | 6.2 | 0.21 |
| Example 22 | (CTM-1) | A/PC-a | 9/10 | 5.8 | 0.21 |
| Example 23 | (CTM-2) | A | 9/10 | 5.2 | 0.2 |
| Example 24 | (CTM-3) | A | 9/10 | 6.8 | 0.2 |
| Example 25 | (CTM-4) | A | 5/10 | 6.5 | 0.16 |
| Example 26 | (CTM-5) | A | 5/10 | 6.7 | 0.13 |
| Example 27 | (CTM-6) | A | 6/10 | 7.1 | 0.15 |
| Example 28 | (CTM-7) | A | 6/10 | 7.3 | 0.16 |
| Example 29 | (CTM-9) | A | 4/10 | 7.8 | 0.11 |
| Comparative Example 1 | (CTM-1) | V | 9/10 | 2.4 | 0.22 |
| Comparative Example 2 | (CTM-1) | W | 9/10 | 2.3 | 0.22 |
| Comparative Example 3 | (CTM-1) | X | 9/10 | 2.1 | 0.31 |
| Comparative Example 4 | (CTM-1) | Y | 9/10 | — | — |
| Comparative Example 5 | (CTM-1) | Z | 9/10 | 2.2 | 0.19 |
| Comparative Example 6 | (CTM-1) | PC-b | 9/10 | 3.9 | 0.51 |
| Comparative Example 7 | (CTM-1) | PC-c | 9/10 | 3.1 | 0.5 |
| Comparative Example 8 | (CTM-2) | V | 9/10 | 1.9 | 0.21 |
| Comparative Example 9 | (CTM-3) | V | 9/10 | 2.1 | 0.22 |
| Comparative Example 10 | (CTM-4) | V | 5/10 | 2.3 | 0.18 |
| Comparative Example 11 | (CTM-5) | V | 5/10 | 2.2 | 0.17 |
| Comparative Example 12 | (CTM-6) | V | 6/10 | 2.4 | 0.18 |
| Comparative Example 13 | (CTM-7) | V | 6/10 | 2.6 | 0.19 |
| Comparative Example 14 | (CTM-9) | V | 4/10 | 2.9 | 0.15 |

Test Results of Comparative Example 15

The charge mobility was $2.6\times10^{-6}$ $cm^2/Vs$, and the decrease in thickness was 0.45 μm.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-030170 filed Feb. 19, 2016, which is hereby incorporated by reference herein in its entirety.

What is claimed is:

1. An electrophotographic photosensitive member comprising a surface layer containing a charge transporting material and a polyester resin having the structure represented by general formula (I) and the structure represented by general formula (II):

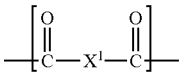

(I)

wherein in general formula (I), $X^1$ represents a divalent group; and

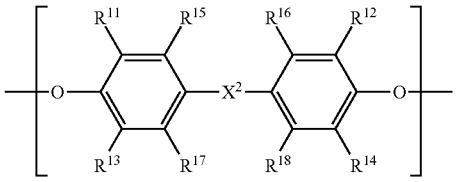

(II)

wherein in general formula (II), $X^2$ represents one selected from the group consisting of a single bond, an oxygen atom, a divalent alkylene group, and a divalent cycloalkylene group, and $R^{11}$ to $R^{18}$ each represent one of a hydrogen atom and an alkyl group, wherein the structure represented by general formula (I) includes the structure represented by formula (I-2):

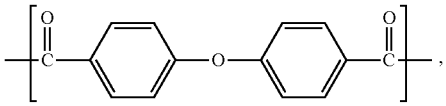

(I-2)

and wherein the structure represented by general formula (II) includes the structure represented by general formula (II-1):

(II-1)

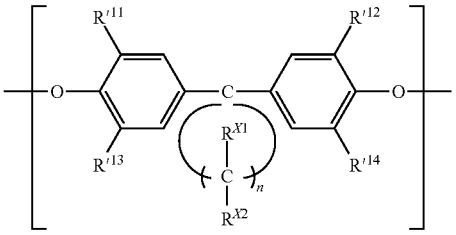

wherein in general formula (II-1), $R^{X1}$ and $R^{X2}$ each represent one selected from the group consisting of a hydrogen atom, a methyl group, and an ethyl group, $R'^{11}$, $R'^{12}$, $R'^{13}$, and $R'^{14}$ each represent one of a hydrogen atom and a methyl group, and n represents an integer in the range of 11 to 18.

2. The electrophotographic photosensitive member according to claim 1, wherein in general formula (II-1), n represents 11.

3. The electrophotographic photosensitive member according to claim 1, wherein the ratio of the moles of the structure represented by formula (I-2), to the total moles of the structure represented by general formula (I) is 30% by mole or more.

4. The electrophotographic photosensitive member according to claim 1, wherein the ratio of the moles of the structure represented by general formula (II-1) to the total moles of the structure represented by general formula (II) is 10% by mole to 70% by mole.

5. The electrophotographic photosensitive member according to claim 1, wherein the structure represented by general formula (II) further includes the structure represented by general formula (II-2):

(II-2)

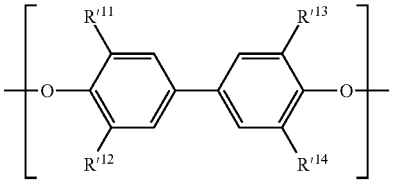

wherein $R'^{11}$, $R'^{12}$, $R'^{13}$, and $R'^{14}$ each represent one of a hydrogen atom and a methyl group.

6. The electrophotographic photosensitive member according to claim 5, wherein the ratio of the moles of the structure represented by general formula (II-1) to the total moles of the structure represented by general formula (II) is 30% by mole to 50% by mole, and the ratio of the moles of the structure represented by general formula (II-2) to the total moles of the structure represented by general formula (II) is 50% by mole to 70% by mole.

7. The electrophotographic photosensitive member according to claim 1, wherein the charge transporting material is a triarylamine compound or a benzidine compound.

8. A process cartridge capable of being removably mounted to an electrophotographic apparatus, the process cartridge comprising: at least one device selected from the group consisting of a charging device, a developing device, a transfer device, and a cleaning device, and an electrophotographic photosensitive member being held together with the at least one device in one body, the electrophotographic photosensitive member including a surface layer containing a charge transporting material and a polyester resin having the structure represented by general formula (I) and the structure represented by general formula (II):

(I)

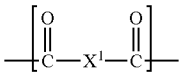

wherein in general formula (I), $X^1$ represents a divalent group; and (II)

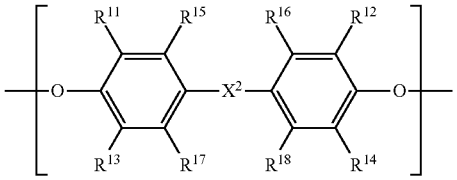

wherein in general formula (II), $X^2$ represents one selected from the group consisting of a single bond, an oxygen atom, a divalent alkylene group, and a divalent cycloalkylene group, and $R^{11}$ to $R^{18}$ each represent one of a hydrogen atom and an alkyl group, wherein the structure represented by general formula (I) includes the structure represented by formula (I-2):

(I-2)

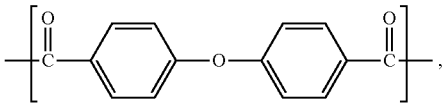

and wherein the structure represented by general formula (II) includes the structure represented by general formula (II-1):

(II-1)

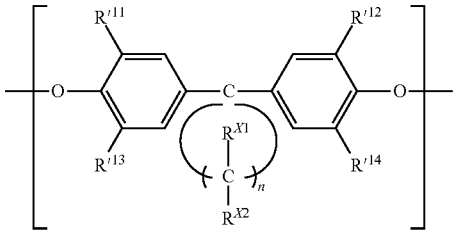

wherein in general formula (II-1), $R^{X1}$ and $R^{X2}$ each represent one selected from the group consisting of a hydrogen atom, a methyl group, and an ethyl group, $R'^{11}$, $R'^{12}$, $R'^{13}$, and $R'^{14}$ each represent one of a hydrogen atom and a methyl group, and n represents an integer in the range of 11 to 18.

9. An electrophotographic apparatus comprising:

a charging device; an exposure device;

a developing device;

a transfer device; and an electrophotographic photosensitive member including a surface layer containing a charge transporting material and a polyester resin having the structure represented by general formula (I) and the structure represented by general formula (II):

(I)

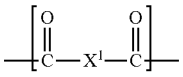

wherein in general formula (I), $X^1$ represents a divalent group; and (II)

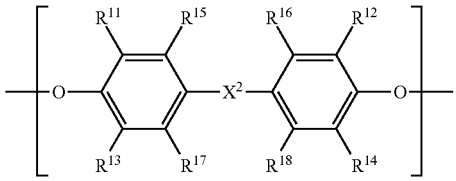

wherein in general formula (II), $X^2$ represents one selected from the group consisting of a single bond, an oxygen atom, a divalent alkylene group, and a divalent cycloalkylene group, and $R^{11}$ to $R^{18}$ each represent one of a hydrogen atom and an alkyl group, wherein the structure represented by general formula (I) includes the structure represented by formula (I-2):

(I-2)

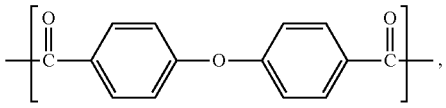

and wherein the structure represented by general formula (II) includes the structure represented by general formula (II-1):

(II-1)

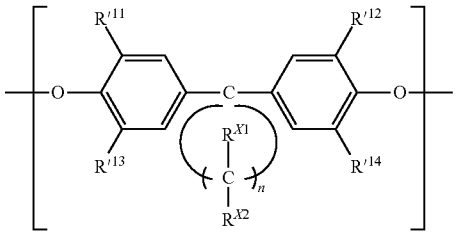

wherein in general formula (II-1), $R^{X1}$ and $R^{X2}$ each represent one selected from the group consisting of a hydrogen atom, a methyl group, and an ethyl group, $R'^{11}$, $R'^{12}$, $R'^{13}$, and $R'^{14}$ each represent one of a hydrogen atom and a methyl group, and n represents an integer in the range of 11 to 18.

* * * * *